US008864128B2

(12) United States Patent
Miyajima

(10) Patent No.: US 8,864,128 B2
(45) Date of Patent: Oct. 21, 2014

(54) SHEET DISCHARGE DEVICE, METHOD FOR DETECTING SHEET-LOADING, COMPUTER READABLE MEDIUM STORING SHEET LOADING-DETECTION PROGRAM, AND IMAGE FORMING APPARATUS INCLUDING SHEET DISCHARGE DEVICE

(71) Applicant: Brother Kogyo Kabushiki Kaisha, Nagoya (JP)

(72) Inventor: Yusuke Miyajima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/040,541

(22) Filed: Sep. 27, 2013

(65) Prior Publication Data

US 2014/0091514 A1 Apr. 3, 2014

(30) Foreign Application Priority Data

Sep. 28, 2012 (JP) ..... 2012-215908

(51) Int. Cl.

| | |
|---|---|
| ***B65H 43/00*** | (2006.01) |
| ***B65H 43/06*** | (2006.01) |
| ***B65H 29/00*** | (2006.01) |
| ***B65H 31/02*** | (2006.01) |

(52) U.S. Cl.

CPC ..... *B65H 29/00* (2013.01); *B65H 43/06* (2013.01); *B65H 2801/06* (2013.01); *B65H 2601/271* (2013.01); *B65H 2513/22* (2013.01); *B65H 2553/612* (2013.01); *B65H 2511/152* (2013.01); *B65H 2301/4212* (2013.01); *B65H 2513/512* (2013.01); *B65H 31/02* (2013.01); *B65H 2801/15* (2013.01); *B65H 2511/11* (2013.01); *B65H 2513/50* (2013.01); *B65H 2511/30* (2013.01); *B65H 2511/515* (2013.01)

USPC ..... 271/176; 271/220

(58) Field of Classification Search

USPC ..... 271/258.01, 258.02, 220, 176, 306

See application file for complete search history.

(56) References Cited

U.S. PATENT DOCUMENTS

| | | | | |
|---|---|---|---|---|
| 5,081,508 | A * | 1/1992 | Kotani et al. | 399/21 |
| 5,963,754 | A * | 10/1999 | Itoh et al. | 399/21 |
| 6,408,147 | B1 * | 6/2002 | Oshida | 399/82 |
| 7,558,493 | B2 * | 7/2009 | Kwon | 399/16 |
| 7,865,127 | B2 * | 1/2011 | Nakajima | 399/406 |
| 8,023,837 | B2 * | 9/2011 | Nishitani et al. | 399/18 |
| 2007/0145675 | A1 * | 6/2007 | Tamura et al. | 271/207 |

FOREIGN PATENT DOCUMENTS

JP H09-020036 A 1/1997

* cited by examiner

*Primary Examiner* — Michael McCullough
*Assistant Examiner* — Howard Sanders
(74) *Attorney, Agent, or Firm* — Merchant & Gould PC

(57) ABSTRACT

There is provided a sheet discharge unit which includes a tray which a first area and a second area, a discharge mechanism, a pendulum mechanism, a signal transmission mechanism which transmits a first signal and a second signal, a memory, and a controller. The controller judges whether or not a time interval of two sheets discharged consecutively exceeds the first time interval, and judges that the sheets loaded onto the tray up to a height not lower than the reference position, when the time interval of the two sheets exceeds the first time interval, and when the signal transmission mechanism continues to transmit the second signal exceeding the first time interval.

13 Claims, 9 Drawing Sheets

| CERTAIN FIXED NUMBER OF SHEETS "N" |
| --- |
| PREDETERMINED TIME "t" |
| CERTAIN FIXED TIME "it" |

81

SHEET DISCHARGE DEVICE, METHOD FOR DETECTING SHEET-LOADING, COMPUTER READABLE MEDIUM STORING SHEET LOADING-DETECTION PROGRAM, AND IMAGE FORMING APPARATUS INCLUDING SHEET DISCHARGE DEVICE

CROSS REFERENCE TO RELATED APPLICATION

The present invention claims priority from Japanese Patent Application No. 2012-215908, filed on Sep. 28, 2012, the disclosure of which is incorporated herein by reference in its entirety.

BACKGROUND OF THE INVENTION

1. Field of the Invention

The present invention relates to a sheet discharge device configured to discharge a sheet which is a recording medium having an image formed thereon, a sheet-loading detection method, a computer readable medium storing a sheet-loading detection program, and an image forming apparatus such as a printer, including the sheet discharge device.

2. Description of the Related Art

A detection mechanism which is configured to detect whether or not sheets are fully loaded in a tray to which the sheets having an image recorded are discharged, has been known. In this detection mechanism, an arrangement is made such that, a pendulum is pivotably installed on a side wall of the tray at an upper side of a sheet discharge opening, and when the tray is empty, the pendulum is inclined downward due to a gravitational force. In a case in which the sheets are fully loaded in the tray, the pendulum is lifted up by the bundle of sheets, and is inclined upward. From the inclination of the pendulum, a state of loading of sheets in the tray is judged. The pendulum is positioned at the upper side of the sheet discharge opening. Therefore, as a sheet is discharged from the sheet discharge opening, the pendulum is lifted up once by the sheets. As a sheet passes the pendulum, the pendulum is inclined downward.

SUMMARY OF THE INVENTION

In a case in which the sheets are discharged continuously from the sheet discharge opening, when a sheet discharge interval is short, the pendulum maintains an attitude or a posture of being inclined upward by the sheets that are discharged continuously. In other words, the pendulum cannot be inclined downward. In such situation, it is not possible to detect accurately whether or not the sheets are fully loaded in the tray.

An object of the present teaching is to detect accurately the fully-loaded state of the tray with sheets, even in a state in which the sheet discharge interval is short, in a case of the sheets being discharged continuously from the sheet discharge opening.

According to a first aspect of the present invention, there is provided a sheet discharge device including:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet; and a controller configured to:

receive a signal transmitted by the signal transmission mechanism;

judge whether or not a time interval of the two sheets discharged consecutively from the discharge opening exceeds the first time interval; and judge that the sheets are loaded onto the tray up to a height not lower than the reference position, under a condition that the controller judges that the time interval of the two sheets exceeds the first time interval, and under a condition that the signal transmission mechanism continues to transmit the second signal exceeding the first time interval.

According to a second aspect of the present teaching, there is provided a method for detecting sheet-loading including:

preparing a sheet discharge device including: a housing in which a discharge opening through which a plurality of sheets are discharged is formed; a tray configured to define a space including a first area in which the sheets being discharged from the discharge opening move, and a second area which is positioned at a lower side of the first area, and in which the sheets discharged from the discharge opening are fallen and loaded; a discharge mechanism configured to transport the sheets, and discharge the sheets one-by-one from the discharge opening; a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space; a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position; a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet, judging whether or not a time interval of the two sheets discharged consecutively from the discharge opening by the discharge mechanism, exceeds a predetermined time; and judging that the sheets loaded onto the tray up to a height not lower than the reference position, under a condition that the time interval of the two sheets is judged to exceed the first time interval, and under a condition that the signal transmission mechanism continues to transmit the second signal exceeding the first time interval.

According to a third aspect of the present teaching, there is provided a non-transitory computer readable medium storing a sheet loading-detection program, the program being configured to execute in a control section of a sheet discharge device including:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet; and a controller configured to receive a signal transmitted by the signal transmission mechanism, the program makes the controller to perform:

judging whether or not a time interval of the two sheets discharged consecutively from the discharge opening by the discharge mechanism, exceeds a predetermined time; and judging that the sheets loaded onto the tray up to a height not lower than the reference position, under a condition that the controller judges that the time interval of the two sheets exceeds the first time interval, and under a condition that the signal transmission mechanism continues to transmit the second signal exceeding the first time interval.

According to a fourth aspect of the present teaching, there is provided a sheet discharge device, including:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet;

a first judging mechanism configured to judge whether or not a time interval of the two sheets discharged consecutively exceeds the first time interval; and a second judging mechanism configured to judge that the sheets loaded onto the tray up to a height not lower than the reference position, under a condition that the first judging mechanism judges that the time interval of the two sheets exceeds the first time interval, and under a condition that the signal transmission mechanism continues to transmit the second signal exceeding the first time interval.

The maximum value of the time interval during which it is possible to lift up the free-end portion of the pendulum mechanism continuously by the two sheets that are discharged consecutively from the discharge opening, is to be set as the predetermined time. In a case in which the time interval in which the two sheets are discharged consecutively is a time exceeding the first time interval, when the height of the sheets loaded in the tray is lower than the reference position, the free-end portion of the pendulum mechanism falls down to a position lower than the reference position, and the signal transmission mechanism is supposed to transmit the first signal. Consequently, when the signal transmission mechanism continues to transmit the second signal till exceeding the first time interval in this case, the control section makes a judgment that the sheets are loaded up to a position not lower than the reference position. When the reference position is set to be same as the fully-loaded amount of sheets in the tray, accordingly, it is possible to detect accurately whether or not the sheets have been fully loaded in the tray.

DETAILED DESCRIPTION OF THE PREFERRED EMBODIMENTS

An embodiment of the present teaching will be described below in detail by using the accompanying diagrams. In the following description, upward and downward indicate a direction along a vertical direction. Moreover, a sheet discharge unit exemplifies a unit which is configured to discharge a sheet P after forming an image thereon, and which is used in an ink-jet recording apparatus. In other words, an ink-jet recording apparatus 1 corresponds to an 'image forming apparatus' of the present teaching.

<Overall Arrangement of Ink-Jet Recording Apparatus>

Figure 1:
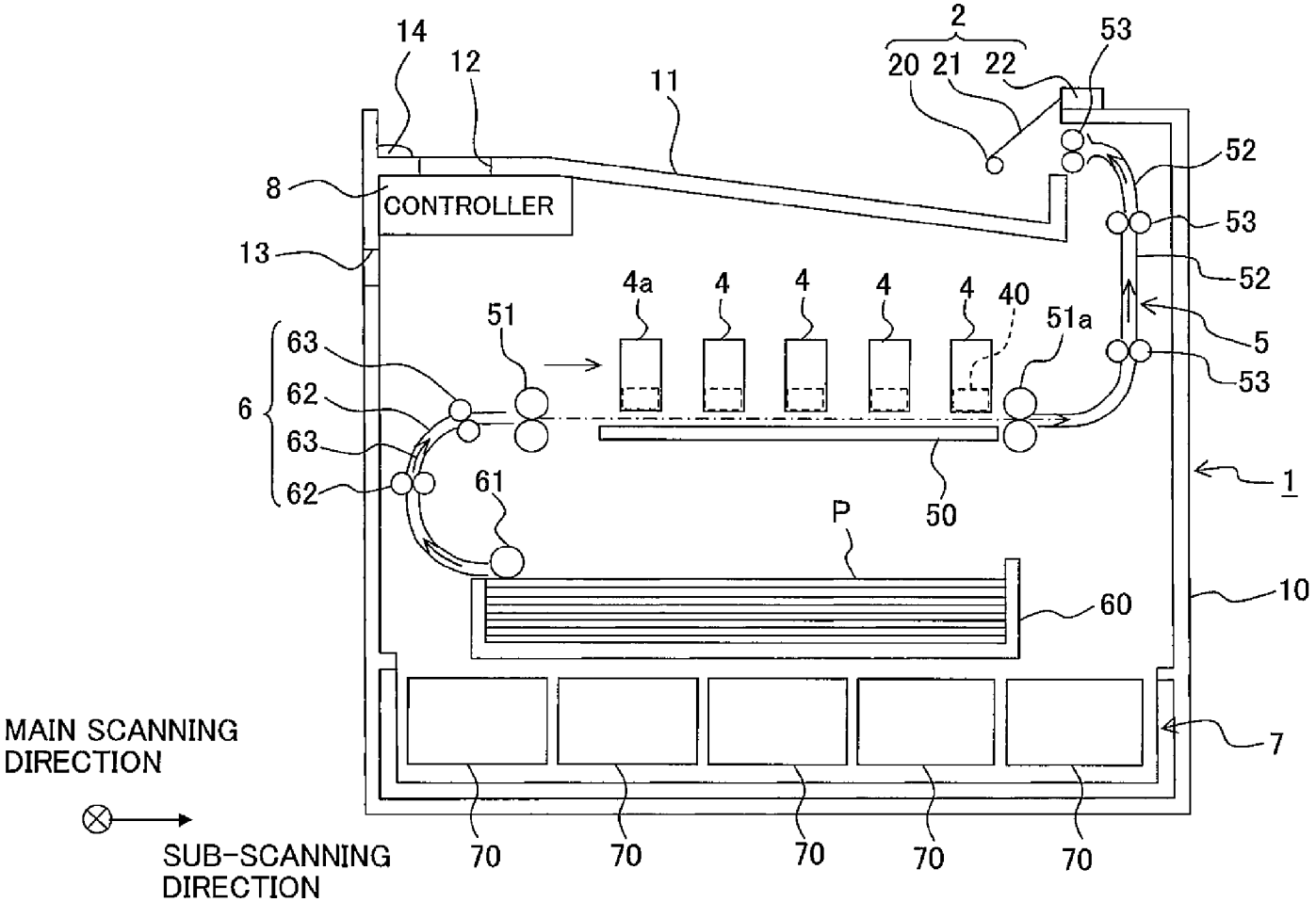
FIG. 1 is a diagram showing an overall arrangement of an ink-jet recording apparatus.
Figure 2:
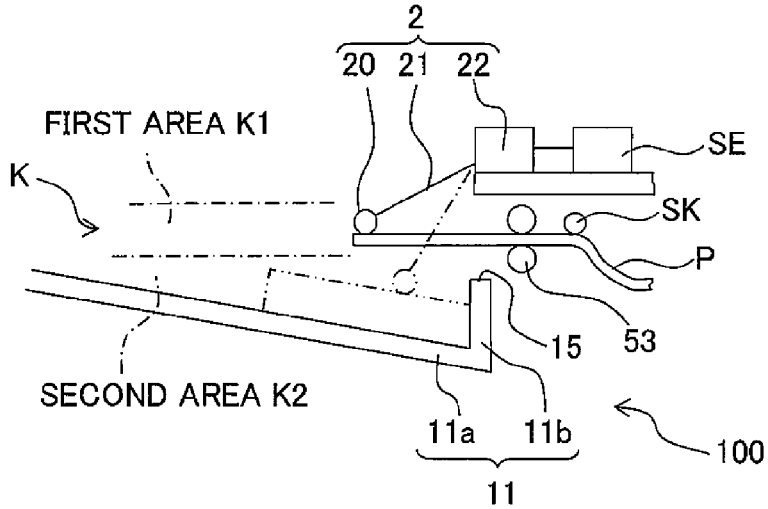
FIG. 2 is an enlarged view showing an arrangement near a tray.

As shown in FIG. 1, the ink-jet recording apparatus 1 includes a housing 10 which is rectangular parallelepiped shaped, and a tray 11 which is provided on an upper portion of a top plate of the housing 10. A plurality of heads 4, a transporting unit 5, a paper feeding unit 6, and a tank group 7 which includes a plurality of tanks 70, are arranged from top to bottom in the housing 10. The heads 4 jet droplets of inks of colors namely black, cyan, magenta, and yellow on to the sheet P. The transporting unit 5 sends the sheet P to the tray 11 after transporting horizontally. The paper feeding unit 6 supplies the sheet P to the transporting unit 5. The tank group 7 includes the plurality of tanks 70 arranged horizontally, in which inks of respective colors are stored. A processing liquid head 4*a* which jets a processing liquid on to the sheet P prior to jetting of the ink is provided at a downstream side of the paper feeding unit 6, and at an upstream side of the heads 4. Here, the processing liquid is a liquid which is to be applied to the sheet P before jetting the ink on to the sheet P, to coagulate or agglutinate a constituent of ink, or to extract or precipitate a constituent of ink, and thereby to maintain a high printing quality or to improve an image quality. The tank group 7 also includes a processing-liquid tank 70*a* in which the processing liquid is stored.

A controller 8 which controls operations of various mechanisms and electric circuits in the housing 10 is arranged at a position at an inner-side upper portion of the housing 10. A terminal 13 to which a print job from an external personal computer is to be input is provided on a side surface of the housing 10 at a lower side of the controller 8. The print job that has been input to the terminal 13 is input to the controller 8. An operation panel 12 which is electrically connected to the controller 8 and on which user inputs various sort of information is provided at an upper surface of the housing 10. An alarm 14, which informs that the sheets P are fully loaded on the tray 11, is provided lateral to the operation panel 12. The alarm 14 informs the user that the sheets P are fully loaded on the tray 11, by audio information and/or visual information. A position of the alarm 14 is not restricted to a position shown in FIG. 1, and it is possible to arrange the alarm 14 at any positions.

The transporting unit 5 is a mechanism which transports the sheet P from left to right in FIG. 1. In the following description, a direction of transporting the sheet P in a print area will be called as a sub-scanning direction or a secondary scanning direction. Further, a direction orthogonal to the sub-scanning direction in a horizontal plane is called as a main scanning direction.

The transporting unit 5 includes a platen 50, and transporting rollers 51 and 51*a* arranged on two sides of the platen 50. The sheet P having a transporting force applied by the transporting roller 51 at an upstream side in a direction of transporting (hereinafter referred to as 'transporting direction') is transported while being supported by an upper surface of the platen 50. The transporting force is imparted to the sheet P which has passed the platen 50 by the transporting roller 51*a* at a downstream side in the transporting direction, and the sheet P is sent to the tray 11 by a guide 52 and a feeding roller 53 positioned between the transporting roller 51*a* and the tray 11. Each of the transporting rollers 51 and 51*a*, and the feeding roller 53 is driven and rotated by a separate motor (not shown).

A discharge opening 15 through which the sheet P is discharged is formed in the housing 10 at a downstream side in the transporting direction of the feeding roller 53. The feeding roller 53 discharges the sheets P one-by-one from the discharge opening 15, and after discharging one sheet P, waits for a predetermined interval at the time of discharging the subsequent sheet P. In other words, the feeding roller 53 is an example of a 'discharge mechanism' of the present teaching. A pendulum mechanism 2 configured to make a contact with the sheet P to be discharged from the tray 11 is provided on the housing 10, at an upper side of the feeding roller 53. An arrangement of the pendulum mechanism 2 will be described later.

The paper feeding unit 6 includes a paper feeding tray 60 and a paper feeding roller 61, and two guides 62 and a feeding roller 63 are arranged between the paper feeding roller 61 and the transporting unit 5. The paper feeding roller 61 draws the sheet P at the uppermost position in the paper feeding tray 60, and the sheet P drawn by the paper feeding roller 61 is transported to an upstream side of the transporting unit 5 by the guide 62 and the feeding roller 63. Several kinds of sheets can be accommodated in the paper feeding tray 60 as the sheets P. For example, in the paper feeding tray 60, it is possible to accommodate sheets having a length short in a direction of discharge (hereinafter referred to as 'discharge direction') such as a B5-size sheet, and sheets having a length long in the discharge direction such as a legal-size sheet. An outer size of the paper feeding tray 60 should be changed or selected in accordance with the length of the sheet P in the discharge direction. Therefore, the feeding tray 60 in accordance with the length in the discharge direction of the sheet P to be used, is installed in the housing 10.

Each of the heads 4 is a line head having a rectangular parallelepiped shape extended in the main scanning direction, and a lower surface of each of the heads 4 is formed as a nozzle surface 40 in which a plurality of nozzles through which an ink is jetted are formed. Each of the heads 4 is connected to the tank 70 corresponding to the color of the ink to be jetted, via a tube (not shown). The ink in the form of ink droplets is jetted toward the sheet P through the liquid jetting holes in the nozzle surface 40. Accordingly, an image is formed on the sheet P, and the printing is carried out.

After the ink is jetted on to certain number of sheets P, a cap (not shown) is put on the nozzle surface 40 of the heads 4, and by jetting forcibly the ink adhered to the liquid jetting holes of the nozzle surface 40, blocking of the nozzle surface 40 is prevented.

This is called as a flushing operation.

The tray 11 includes a base plate 11*a* which is inclined downward toward the discharge opening 15, and a vertical wall 11*b* which is protruded upward from a right-end portion of the base plate 11*a*. A space K at an upper side of the base plate 11*a* includes a first area K1 through which a sheet discharged from the discharge opening 15 moves, and a second area K2 which is positioned at a lower side of the first area K1. In the second area K2, the sheets P which are discharged from the discharge opening 15 are fallen and are loaded or stacked onto the base plate 11*a*.

A sheet discharge unit 100 includes the tray 11, the feeding roller 53, the pendulum mechanism 2, and the controller 8. The pendulum mechanism 2 includes a casing 22 positioned above the housing 10, and a pendulum 21 which is inclined downward from the casing 22 toward the tray 11. A weight 20 is provided to a front-end portion of the pendulum 21, which is a free-end portion of the pendulum 21, and the pendulum 21 is provided to be pivotable in the first area K1 and the second area K2 with a base-end portion as a center, wherein the base-end portion is located on an opposite side of the front-end portion. An angle sensor SE configured to output a signal corresponding to an angle of rotation of the pendulum 21, or in other words, a signal corresponding to a height-wise position of the weight 20, is connected to the casing 22. A sheet detection sensor SK of optical type, which detects the sheet P which passes, is provided to be facing a discharge path of the sheet P, at an inner side of the housing 10. For instance, the sheet detection sensor SK outputs an ON signal when the sheet P passes, and outputs an OFF signal between the two consecutive sheets P, or in other words, when the sheet P is not passing. As a matter of course, the sheet detection sensor SK may output reverse or opposite signals. That is, the sheet detection sensor SK may output the ON signal when the sheet P is not passing, and may output the OFF signal when the sheet P passes. Further, a signal of arbitrary form may be output from the sheet detection sensor SK provided that the passing of the sheet P can be identified.

Figure 3A:
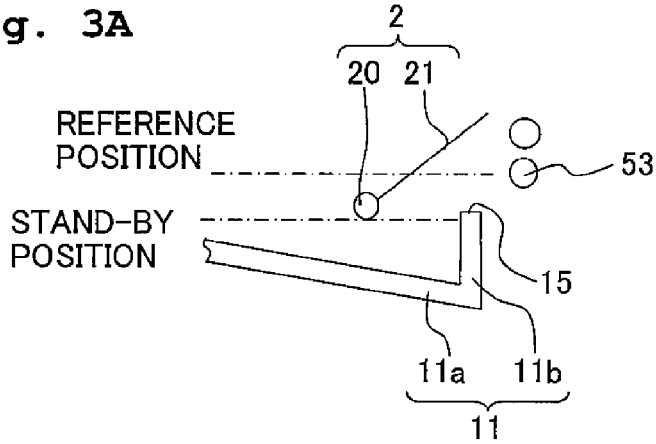
FIG. 3A and FIG. 3B are enlarged views showing positions of a pendulum.

When the sheet P is not discharged to the space K from the discharge opening 15, the pendulum 21 maintains an attitude or posture of being inclined downward due to a weight of the weight 20. Alternatively, it is possible to provide a bias applying member (not shown) configured to apply a biasing force so that the pendulum 21 maintains an attitude of being inclined downward. A height-wise position of the weight 20 of the pendulum 21 at this time is referred to as a stand-by position (refer to FIG. 3A). The stand-by position is located within the second area K2. In a state of the weight 20 at the stand-by position, the sheets P are not loaded fully on the base plate 11*a*, and the weight 20 is lifted up by the sheet P which is discharged from the discharge opening 15, or by the sheet P which is loaded on the base plate 11. In a state of the sheets P fully loaded on the base plate 11*a*, the weight 20 makes a contact with the sheet P at the uppermost position, at a reference position which is higher than the stand-by position. The weight 20 is not necessarily required to be provided to the free-end portion of the pendulum 21. In a case in which a shaft portion of the pendulum 21 has appropriate weight for instance, the weight 20 may not be provided to the front end.

Figure 3B:
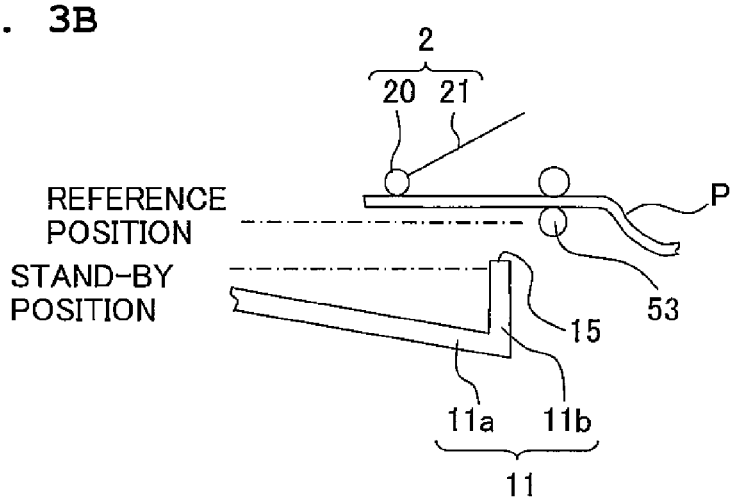

When the sheet P is discharged from the discharge opening 15, the sheet P is discharged horizontally from the discharge opening 15 as shown in FIG. 3B. At this time, the sheet P lifts up the weight 20 to a position slightly higher than the reference position. This position which is slightly higher than the reference position is located within the first area K1.

The angle sensor SE transmits a first signal when the height-wise position of the weight 20 is lower than the reference position, and is at same height of or higher than the stand-by position. The angle sensor SE transmits a second signal having a level different from a level of the first signal when the height-wise position of the weight 20 is at the same height of or higher than the reference position. In other words, the angle sensor SE forms a 'signal generator' of the present teaching.

As it has been mentioned above, since the height of the reference position corresponds to the uppermost position of the sheet P in the state of being loaded fully, the angle sensor SE transmits the second signal either in a case in which the sheets P are fully loaded on the base plate 11*a*, or in a case in which the sheet P is discharged from the discharge opening 15 to the space K. The first signal or the second signal may be a signal having a mutually different voltage level, and one of the first signal and the second signal may be 0 V. 0 V in this case does not correspond to a no-signal, but correspond to an output voltage of 0 V.

Figure 4:
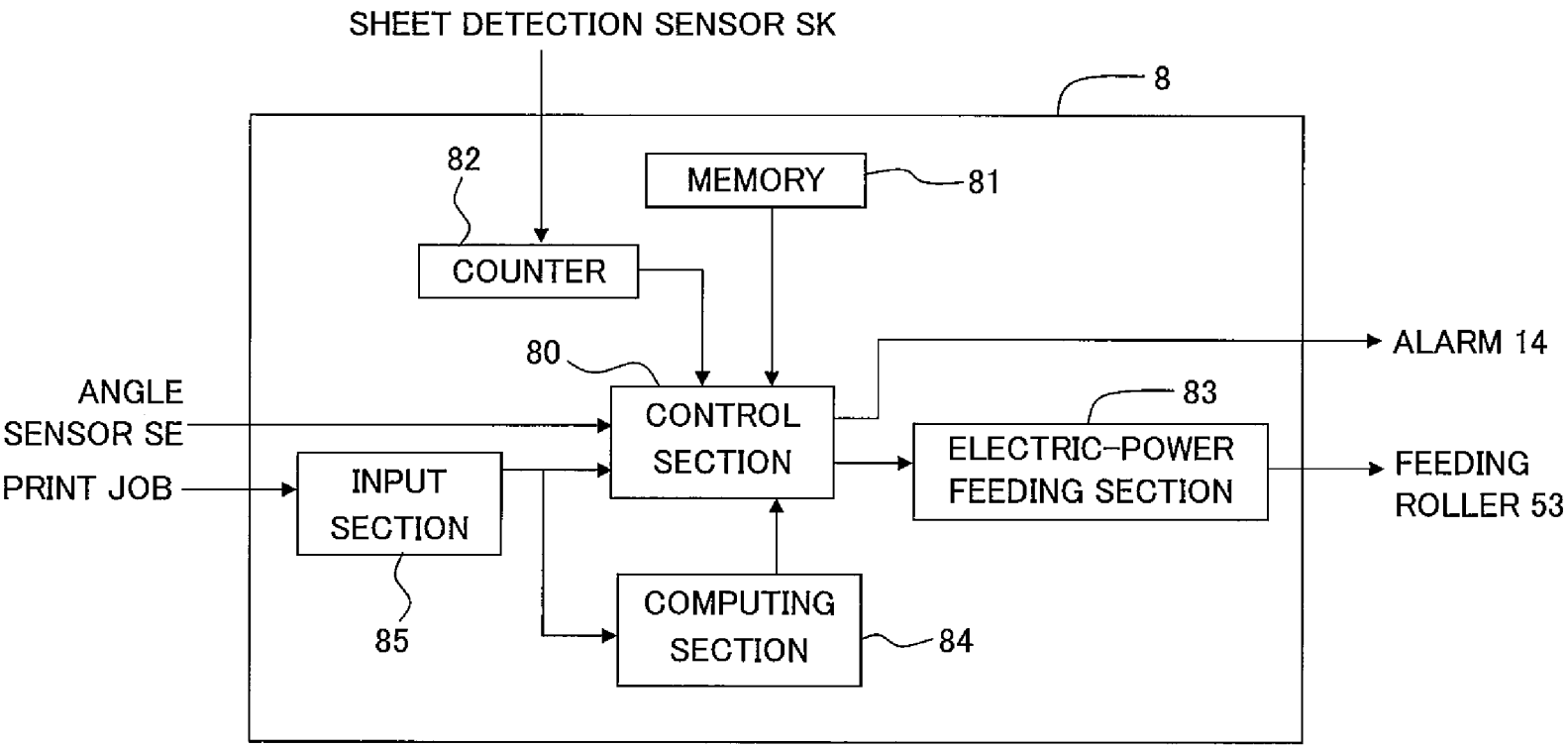
FIG. 4 is a block diagram of an interior of a controller.

As shown in FIG. 4, a control section 80 is included in the controller 8, and the control section 80 is connected to a memory 81, an input section 85 to which a print job is input, and an electric-power feeding section 83 which feeds electric power separately to components which are driven and rotated, such as the motor of the feeding roller 53.

A signal of the angle sensor SE is input to the control section 80. A counter 82 counts the number of sheets P discharged from the tray 11, from a signal transmitted from the sheet detection sensor SK. The counter 82 and the sheet detection sensor SK form a 'counter mechanism' of the present teaching. The counter 82 is connected to the control section 80, and a value of a certain number N of sheets P is stored in the memory 81.

In the embodiment, the control section 80 includes one CPU. However, the present embodiment is not restricted to such arrangement, and the control section 80 may include a combination of a plurality of CPUs for instance. Moreover, the CPU and an ASIC (Application Specific Integrated Circuit) may be used. The control section 80 divides the frequency of an internal clock to use as a timer. That is, the control section 80 functions as a frequency divider.

Figures 5, 6:
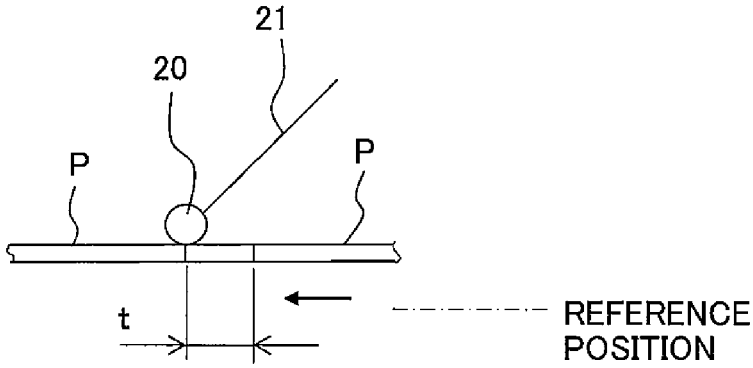
FIG. 5 is a diagram showing a state of a spindle being lifted up continuously by a sheet.
FIG. 6 is a diagram showing a table of a memory.

A value of a predetermined time t is stored in the memory 81. Here, the predetermined time t, as shown in FIG. 5, is a time interval of the two sheets P discharged consecutively, and is the maximum value of a time interval which enables the weight 20 lifted up higher than the reference position temporarily by the former sheet P, to maintain a height not lower than the reference position upon being lifted up by the latter sheet P. It is possible to obtain the value of the predetermined time t by measuring the time interval when the two consecutive sheets P are discharged practically.

A value of a certain fixed time 'it', which is a time of stopping the feeding roller 53 is also stored in the memory 81. Consequently, the values of the certain fixed number N of sheets P, the predetermined time t, and the certain fixed time 'it' are stored in the memory 81 as shown in FIG. 6.

The print job is input to a computing section 84 via the input section 85. The computing section 84 is connected to the control section 80. The print job includes information of a size of the sheet P, or in other words, a length of the sheet P in the discharge direction, and the number of sheets P. The computing section 84 calculates a time interval t2 of the two sheets P discharged consecutively, from the length of the sheet P in the discharge direction included in the print job.

Concretely, when the length of the sheet P in the discharge direction is divided by a rotational velocity of the feeding roller 53, it is possible to calculate time t1 after a front-end portion of the sheet P touches the weight 20 till the sheet P finishes passing the weight 20. At this time, the time t1 corresponds to time during which the weight 20 continues to make a contact with one sheet P. Moreover, a time 'ts' required at the time of printing the M1 number of sheets P included in one print job has also been calculated. Consequently, the computing section 84 calculates the time interval 't2' of the two sheets P that are discharged consecutively, from the following expression (1).

$$t1 \times M1 + t2 \times (M1 - 1) + \text{vacant time} \leq ts \quad (1)$$

In the ink-jet recording apparatus 1, after having printed the M1 number of sheets P included in one print job, the abovementioned flushing operation is carried out before printing the first sheet P of the subsequent print job, and a voltage to be supplied to the head 4 is adjusted. The vacant time in expression (1) is a time required for adjusting the voltage to be supplied to the head 4 and the flushing operation. Data of the time interval t2 calculated by the computing section 84 is transmitted to the control section.

<Discharge Control of Sheet>

Figure 7:
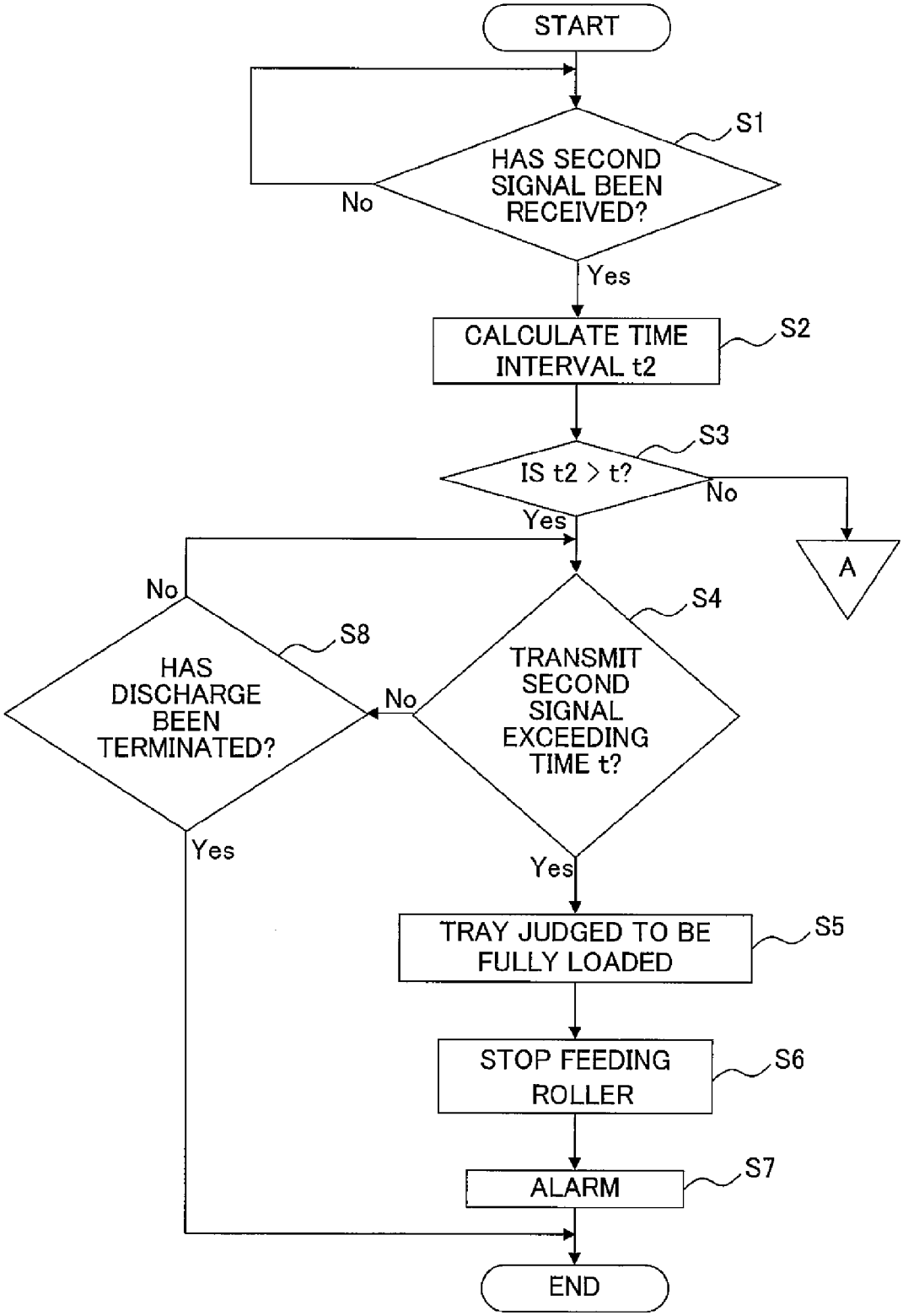
FIG. 7 is a flowchart showing a control operation of the controller at the time of sheet discharge.
Figure 9:
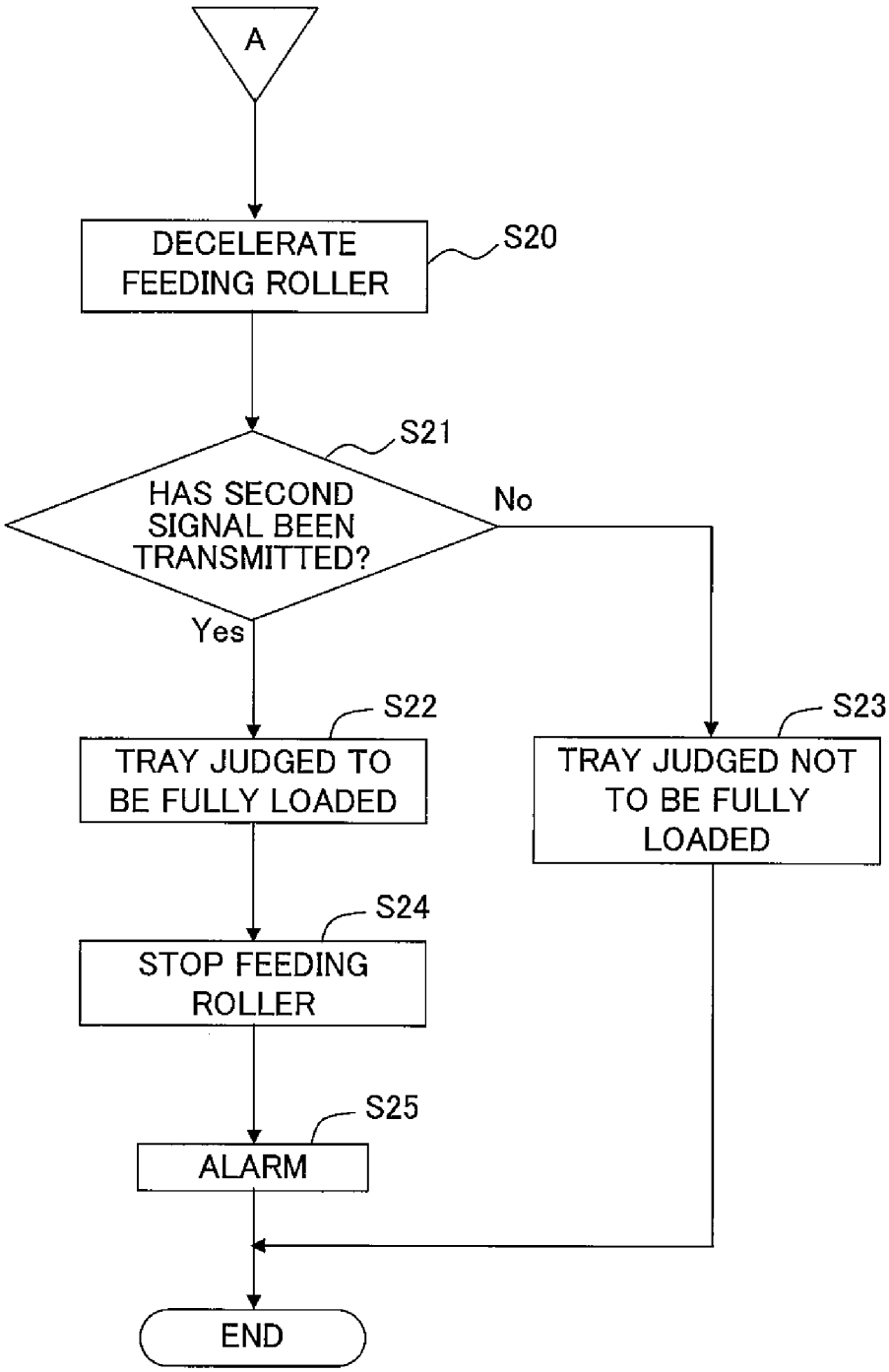
FIG. 9 is a flowchart showing a control operation of the controller at the time of sheet discharge.

At the time of discharging consecutively the sheets P to the tray 11 one-by-one by the feeding roller 53, the controller 8 carries out an operation shown in a flowchart in FIG. 7 and a flowchart in FIG. 9. The sheet P is discharged from the discharge opening 15, and the sheet P lifts up the weight 20 to a position not lower than the reference position. Consequently, the second signal is transmitted from the angle sensor SE (step S1, hereinafter simply referred to as S1). The computing section 84 calculates the value of the time interval t2 of the two sheets P from expression (1), and transmits to the control section 80 (S2).

Next, the control section 80 compares the value of the time interval t2 which the computing section 84 has calculated, and the predetermined time t read from the memory 81, and makes a judgment of whether or not the time interval t2 exceeds the predetermined time t. In a case in which the time interval t2 has exceeded the predetermined time t, the weight 20 is supposed to fall down to a position lower than the reference position as long as the sheets P are not fully loaded on the tray 11. Consequently, in the case in which the time interval t2 has exceeded the predetermined time t, the control section 80 makes a judgment of whether or not the second signal has been transmitted continuously from the angle sensor SE for the time longer than the predetermined time t (S4).

In a case in which the time interval t2 for which the two sheets P are discharged consecutively exceeds the predetermined time t, and also in a case in which the height of the sheets P loaded on the tray 11 is lower than the reference position, the angle sensor SE is supposed to transmit the first signal. Consequently, in a case in which the angle sensor SE has continued to transmit the second signal, it can be presumed that the weight 20 can not be fallen from the reference position because the sheets P are fully loaded on the tray 11. Therefore, the control section 80 makes a judgment that the tray 11 is in a fully-loaded state (S5). The control section 80 controls the electric-power feeding section 83 to stop the feeding roller 53 (S6), and by activating the alarm 14, informs the user that the tray 11 is in the fully-loaded state (S7).

At step S4, when the second signal has not been transmitted any more from the angle sensor SE, and the first signal has been transmitted from the angle sensor SE, the control section 80 makes a judgment of whether all the sheets P included in the print job have been discharged (S8). In a case in which all the sheets P included in the print job have been discharged, the process is terminated, and in a case in which all the sheets P included in the print job have not been discharged, the process returns to step S4.

At step S3, in a case in which the time interval t2 is not longer than the predetermined t, it can be presumed that the sheets P have been discharged consecutively, and the weight 20 is in a state of being continuously lifted up from the reference position by the sheet P. In this case, the control section 80 reads the value of the certain fixed time 'it' from the memory 81, and stops the feeding roller 53 only for the certain fixed time 'it' (S11). Since the certain fixed time 'it' has been set to be longer than the predetermined time t, it is possible that the weight 20 that has been lifted up from the reference position falls down to a position lower than the reference position during the certain fixed time 'it'.

When the angle sensor SE continues to transmit the second signal even after the feeding roller 53 has been stopped for the certain fixed time 'it', it can be presumed that the weight 20 is lifted up to the reference position or higher than the reference position. Consequently, the control section 80 makes a judgment that the sheets P are fully loaded on the tray 11 (S12 and S13). In that case, the control section 80 controls the electric-power feeding section 83 to stop the feeding roller 53 (S16), and activates the alarm 14 to inform the user that the tray 11 is in the fully-loaded state (S17). When the first signal has been transmitted from the angle sensor SE after the control section 80 has stopped the feeding roller 53 only for the certain fixed time 'it', the control section 80 makes a judgment that the sheets P are not fully loaded on the tray 11 (S14). In this case, the sheets P can be loaded further on the tray 11.

However, when the time interval t2 is set as a time not longer than the predetermined time t, the angle sensor SE continues to transmit the second signal during the sheet discharge. Therefore, even when the tray 11 is fully loaded by the sheets P, it is not possible to distinguish the fully-loaded state. Consequently, in a case in which the sheets P can be discharged to the tray 11, the control section 80 controls the electric-power feeding section 83 to decelerate the feeding roller 53 such that the time interval t2 exceeds the predetermined time t (S15).

As all the sheets P in one print job are printed, the control section 80 executes the flushing operation and a voltage adjustment to the head 4. At the time of printing the sheets P in the subsequent print job, the control section 80 repeats the control operation at steps from step S1 onward.

In a case in which the time interval t2 is not longer than the predetermined time t, the feeding roller 53 may be decelerated such that the time interval t2 exceeds the predetermined time t without stopping the feeding roller 53 for the certain fixed time 'it', as shown at step S11.

According to the flowchart in this case, as shown in FIG. 9, the control section 80 decelerates the feeding roller 53 such that the time interval t2 exceeds the predetermined time t (S20). In a case in which the angle sensor SE continues to transmit the second signal even when the time interval t2 has exceeded the predetermined time t, it can be presumed that the weight 20 is located at a position not lower than the reference position, in spite of the weight 20 not being lifted up by the moving sheet P that is being transported. Therefore, it is possible to make a judgment that the tray 11 is fully-loaded by the sheets P (steps S21 and S22). In that case, the control section 80 controls the electric-power feeding section 83 to stop the feeding roller 53 (S24), and activates the alarm 14 to inform the user that the tray 11 is in a fully-loaded state (S25). In a case in which the first signal is transmitted from the angle sensor SE after the feeding roller 53 has been stopped only for the certain fixed time 'it', the control unit 80 makes a judgment that the tray 11 is not yet fully loaded by the sheets P (S23). In this case, it is possible to load further the sheets P onto the tray 11.

Effect of Embodiment

The maximum value of the time interval t2 during which it is possible to lift up the weight 20 continuously by two sheets discharged consecutively from the discharge opening 15 in the time interval is set to be the predetermined time t. In a case that the time interval t2 in which the two consecutive sheets P are discharged exceeds the predetermined time t, and that the height of the sheets P loaded on the tray 11 is lower than the reference position, the weight 20 descends down to a position lower than the reference position, and the angle sensor SE is supposed to transmit the first signal. Consequently, when the angle sensor SE continues to transmit the second signal in this case, the control section 80 makes a judgment that the sheets Pup to a position not lower than the reference position are loaded on the tray 11. When the reference position is set equivalent to fully-loaded amount of sheets P on the tray 11, accordingly, it is possible to detect accurately whether or not the sheets P are fully loaded on the tray 11.

Figure 8:
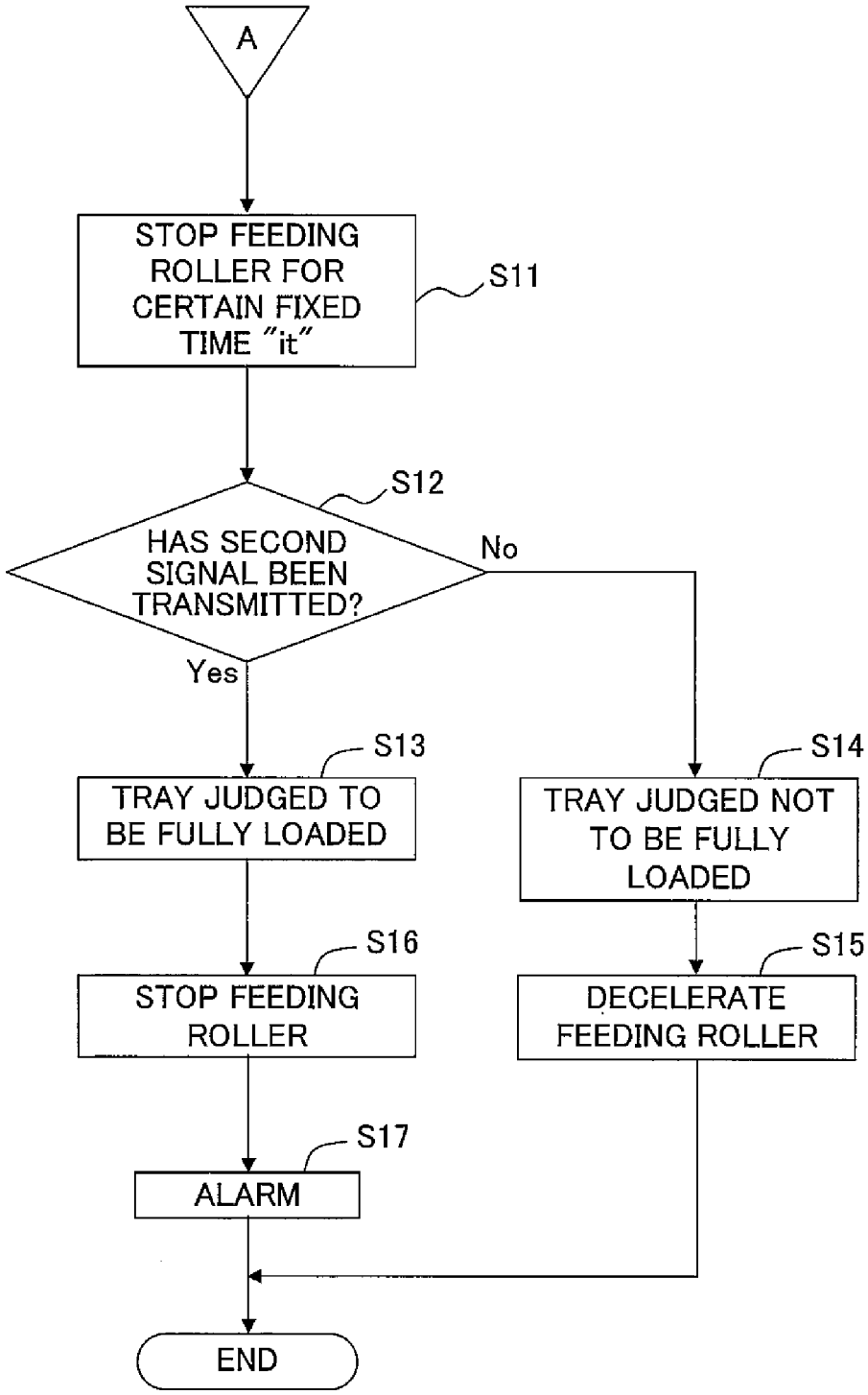
FIG. 8 is a flowchart showing a control operation of the controller at the time of sheet discharge.
Figure 10:
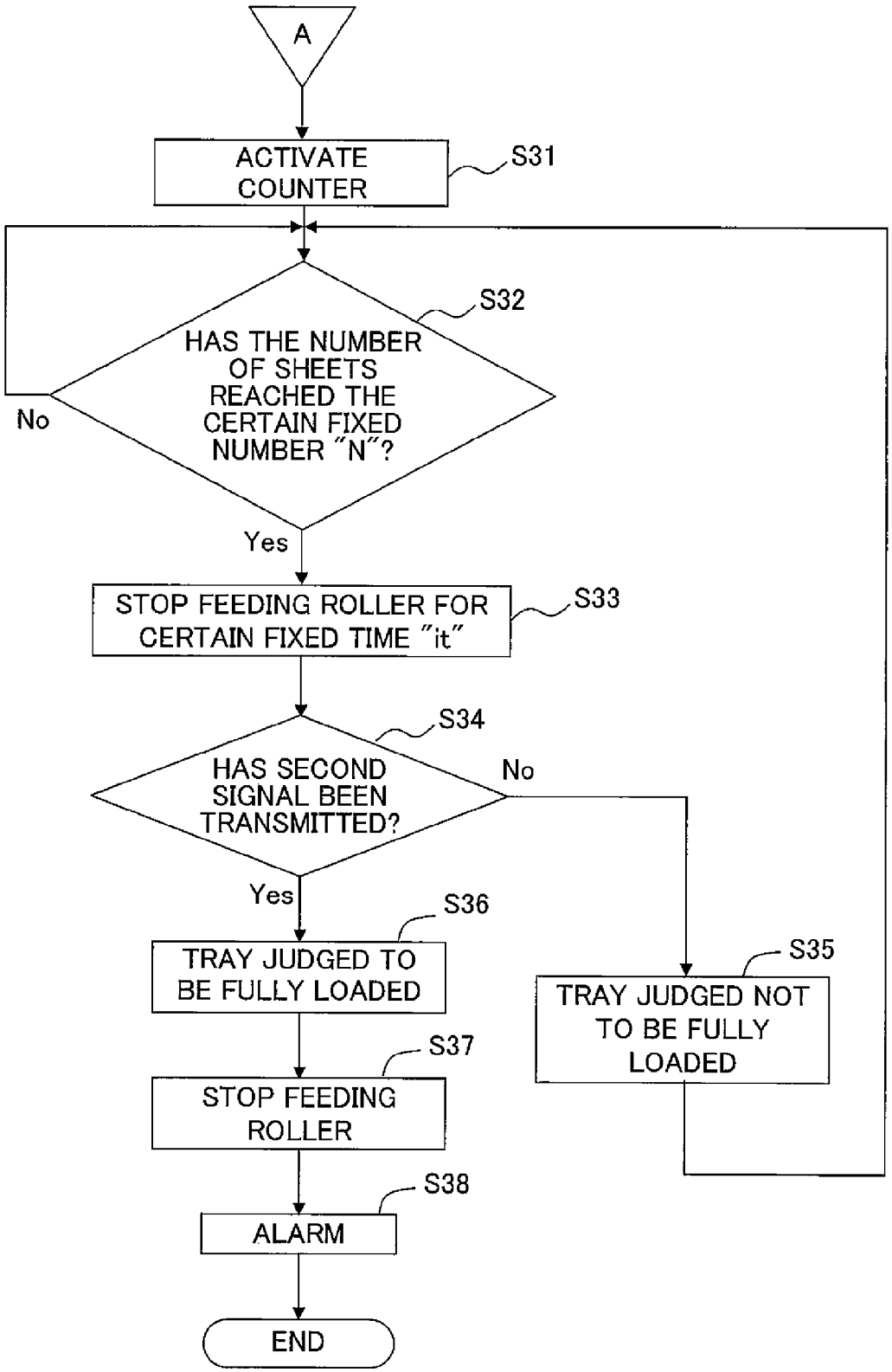
FIG. 10 is a flowchart showing a control operation of the controller at the time of sheet discharge.

In the abovementioned embodiment, in a case that the time interval t2 is not longer than the predetermined time t, and that the tray is not in fully-loaded state, the feeding roller 53 is decelerated. However, it is not possible to increase the number of sheets P discharged per unit time. In other words, since the time interval t2 is adjusted to exceed the predetermined time, it is not possible to increase a discharge velocity. Therefore, in a case of discharging the sheets P continuously at a high velocity, an operation shown in a flowchart in FIG. 10 may be carried out instead of an operation in a flowchart in FIG. 8 and a flowchart in FIG. 9.

The control section 80 activates the counter 82, and the counter 82 counts the number of sheets P discharged to the tray 11, based on an OFF signal and an ON signal transmitted by the sheet detection sensor SK alternately (S31). Next, the control section 80, upon reading the value of the certain fixed number N of sheets P from the memory 81, compares the value of the certain fixed number N of sheets P read with an output from the counter 82, and makes a judgment of whether or not the number of sheets P discharged to the tray 11 has reached the certain fixed number N (S32). In a case in which the number of sheets P has reached the certain fixed number N of sheets P, the control section 80 reads the value of the certain fixed time 'it' from the memory 81, and stops the feeding roller 53 only for the certain fixed time 'it' (S33). The certain fixed time 'it', as mentioned above, is set to be longer than the predetermined time t. Therefore, there is a possibility that the weight 20 which has been lifted up from the reference position fall down to a position lower than the reference position in the certain fixed time 'it'.

In a case in which the angle sensor SE continues to transmit the second signal even after the feeding roller 53 has been stopped only for the certain fixed time 'it', it can be presumed that the weight 20 is lifted up to the reference position or higher. Consequently, the control section 80 makes a judgment that the tray 11 is in fully loaded state by the sheets P (S34 and S36). In that case, the control section 80 controls the electric-power feeding section 83 to stop the feeding roller 53 (S37), and activates the alarm 14 to inform the user that the tray 11 is in the fully-loaded state (S38). When the first signal is transmitted from the angle sensor SE after the control section 80 has stopped the feeding roller 53 only for the certain fixed time 'it', the control section 80 makes a judgment that the sheets P are not fully loaded on the tray 11 (S35). Therefore, it is possible to further load the sheets P on the tray 11. The control section 80 restarts the rotation of the feeding roller 53, and once again discharges the sheets P to the tray 11. At this time, the counter 82 may be set to 0 once.

In the embodiment described heretofore, the time interval of the two sheets P discharged consecutively is changed according to the length of the sheet in the discharge direction. However, in a case in which the length of the sheet P in the discharge direction is extremely short, the time interval of the two sheets P discharged consecutively may become sufficiently long. In such a case, it is not necessary to carry out the control operation described in steps from S1 to S15. Moreover, in a case of carrying out two-sided printing on the sheet P, after carrying out printing on one side of one sheet P, printing is carried out on the other side of the same sheet P. Therefore, the sheets P are not discharged consecutively. Therefore, in this case also, it is not necessary to carry out the control operation described in steps from S1 to S15.

Furthermore, in the flowchart in FIG. 7, when a judgment has been made that the sheets P are fully loaded on the tray 11, the feeding roller 53 is stopped, and maintenance operation of the head 4 may be carried out thereafter.

Other Application Examples

Figure 11:
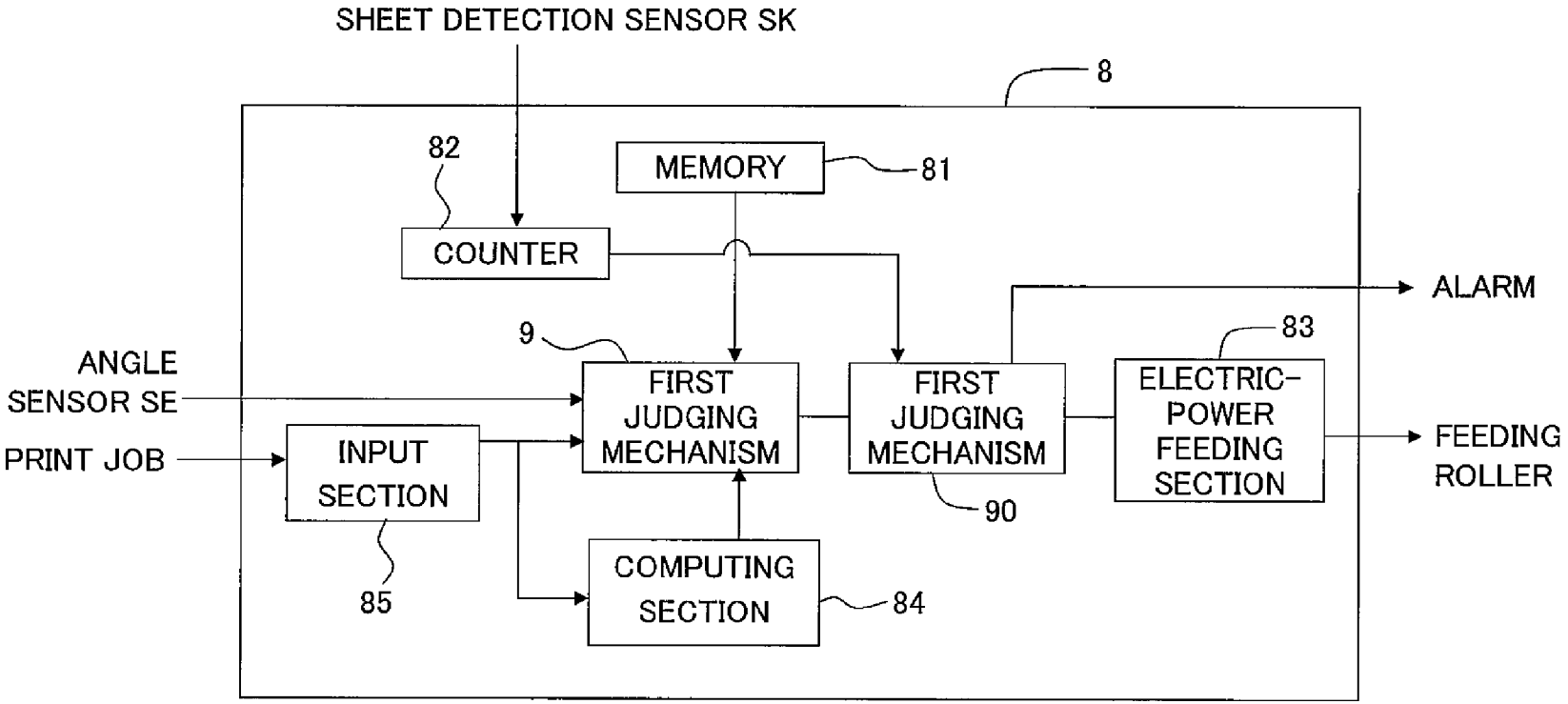
FIG. 11 is a block diagram of an interior of a controller of another application example.

As another application example, an example shown in FIG. 11 may be taken into consideration. An arrangement includes a first judging mechanism 9, and a second judging mechanism 90 connected to the first judging mechanism 9, instead of the control section 80. The computing section 84 and the memory 81 are connected to the first judging mechanism 9, and the counter 82 is connected to the second judging mechanism 90. When the sheets P are discharged continuously by the feeding roller 53, the first judging mechanism 9 makes a judgment of whether or not the time interval t2 of the two sheets P exceeds the predetermined time t in the memory 81. In other words, process at steps from S1 to S3 in the flowchart in FIG. 7 is executed. The second judging mechanism 90 receives a judgment result of the first judging mechanism 9. In a case in which the time interval t2 exceeds the predetermined time t, when the angle sensor SE continues to transmit the second signal exceeding the predetermined time t, the second judging mechanism 90 makes a judgment that the sheets P are fully loaded on the tray 11.

In this case, the first judging mechanism 9 and the second judging mechanism 90 may be formed by an ASIC.

In the abovementioned arrangement, in a case in which a judgment is made that the sheets P are fully loaded on the tray 11, the rotation of the feeding roller 53 is stopped. However, instead of stopping the rotation of the feeding roller 53, a control may be carried out such that a rotational velocity of the feeding roller 53 is reduced, such that the sheet P is not discharged from the discharge opening 15. Moreover, instead of changing the rotational velocity of the feeding roller 53, a control may be carried out such that an interval between the sheets P which are transported continuously is increased, such that the sheet P is not discharged from the discharge opening 15.

In the embodiment described above, a method of calculating the time interval of two consecutive sheets P from the print job has been used. However, an actual time interval may be calculated by the sheet detection sensor, and used successively.

The present teaching is useful for a sheet discharge unit which includes a pendulum mechanism that detects whether or not the sheets are fully loaded, and an image forming apparatus which includes the sheet discharge unit.

What is claimed is:

1. A sheet discharge device, comprising:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet; and a controller configured to:

receive a signal transmitted by the signal transmission mechanism;

judge whether or not a time interval of the two sheets discharged consecutively from the discharge opening exceeds the first time interval; and judge that the sheets are loaded onto the tray up to a height not lower than the reference position, under a condition that the controller judges that the time interval of the two sheets exceeds the first time interval, and under a condition that the signal transmission mechanism continues to transmit the second signal exceeding the first time interval.

2. The sheet discharge device according to claim 1, wherein the controller is configured to stop the discharge mechanism only for a second time interval which is longer than the first time interval, under a condition that the time interval in which the two sheets are discharged is not longer than the first time interval, and under a condition that the signal transmission mechanism continues to transmit the second signal, and the controller is configured to judge that the sheets are loaded onto the tray up to a position not lower than the reference position, under a condition that the signal transmission mechanism continues to transmit the second signal even after the second time interval has elapsed.

3. The sheet discharge device according to claim 2, further comprising:

an alarm configured to inform that the discharge mechanism has stopped, wherein the controller is configured to stop the discharge mechanism and to activate the alarm, in a case that the signal transmission mechanism continues to transmit the second signal even after the second time interval has elapsed.

4. The sheet discharge device according to claim 1, wherein the controller is configured to stop the discharge mechanism, under a condition that the controller judges that the time interval of the two sheets has exceeded the first time interval, and under a condition that the signal transmission mechanism continues to transmit the second signal exceeding the first time interval.

5. An image forming apparatus configured to form an image on a sheet, comprising:

a sheet discharge device according to claim 1;

an input section to which a print job including information of a size of a sheet and information of the number of sheets, is input; and a computing section which is connected to the input section and the discharge mechanism, and which is configured to compute a time interval of at least two sheets that are discharged consecutively from the discharge opening, based on the information of the number of sheets in the print job.

6. The image forming apparatus according to claim 5, wherein the controller is configured to decrease a sheet-discharge velocity of the discharge mechanism, and elongate the time interval of the two sheets, under a condition that the time interval of the two sheets computed by the computing section is not longer than the first time interval.

7. The image forming apparatus according to claim 5, further comprising:

a counter configured to count the number of sheets that are discharged onto the tray;

wherein the controller is connected to the counter, and the controller is configured to change the time interval of the two sheets discharged consecutively from the discharge opening such that the time interval of the two sheets becomes long, and brings the number of sheets discharged per unit time, closer the certain fixed number, under a condition that the number of sheets discharged per unit time is not less than a certain fixed number.

8. The sheet discharge device according to claim 1, wherein the controller includes: a first judging mechanism which is configured to judge whether or not a time interval of the two sheets discharged consecutively from the discharge opening by the discharge mechanism, exceeds the first time interval; and a second judging mechanism which is configured to judge that the sheets have been loaded onto the tray up to a height not lower than the reference position, under a condition that the controller judges that the time interval of the two sheets exceeds the first time interval, and under a condition that the signal transmission mechanism continues to transmit the second signal exceeding the first time interval.

9. The sheet discharge device according to claim 1, wherein the signal transmission mechanism includes an angle detection sensor configured to detect an angle of oscillation of the pendulum mechanism, and transmits one of the first signal and the second signal based on the angle that has been detected by the angle detection sensor.

10. The sheet discharge device according to claim 1, wherein the pendulum mechanism includes a weight which is provided to the free-end portion.

11. A method for detecting sheet-loading, comprising:

preparing a sheet discharge unit configured to discharge a plurality of sheets, including: a housing in which a discharge opening through which the sheets are discharged is formed; a tray configured to define a space including a first area in which the sheets being discharged from the discharge opening move, and a second area which is positioned at a lower side of the first area, and in which the sheets discharged from the discharge opening are fallen and loaded; a discharge mechanism configured to transport the sheets, and discharge the sheets one-by-one from the discharge opening; a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space; a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position; a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet, judging whether or not a time interval of the two sheets discharged consecutively from the discharge opening by the discharge mechanism, exceeds a predetermined time; and judging that the sheets loaded onto the tray up to a height not lower than the reference position, under a condition that the time interval of the two sheets is judged to exceed the first time interval, and under a condition that the signal transmission mechanism continues to transmit the second signal exceeding the first time interval.

12. A non-transitory computer readable medium storing a sheet loading-detection program, the program being configured to execute in a control section of a sheet discharge device including:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet; and a controller configured to receive a signal transmitted by the signal transmission mechanism, the program makes the controller to perform:

judging whether or not a time interval of the two sheets discharged consecutively from the discharge opening by the discharge mechanism, exceeds a predetermined time; and judging that the sheets loaded onto the tray up to a height not lower than the reference position, under a condition that the controller judges that the time interval of the two sheets exceeds the first time interval, and under a condition that the signal transmission mechanism continues to transmit the second signal exceeding the first time interval.

13. A sheet discharge device comprising:

a housing in which a discharge opening through which a plurality of sheets are discharged is formed;

a tray configured to define a space including a first area in which the sheets being discharged from the discharge opening move, and a second area which is positioned at a lower side of the first area, and in which the sheets discharged from the discharge opening are fallen and loaded;

a discharge mechanism configured to transport the sheets, and discharge the sheets one-by-one from the discharge opening;

a pendulum mechanism which includes a free-end portion and a base-end portion, which is pivotably provided such that the free-end portion is displaced in the space of the tray, and which is arranged such that, the free-end portion is lifted up to a stand-by position by the sheets that are discharged from the discharge opening or by the sheets loaded in the space;

a signal transmission mechanism configured to transmit a first signal in a case that a height of the free-end portion is lower than a reference position which is set at a position higher than the stand-by position, and to transmit a second signal which differs from the first signal, in a case that the height of the free-end portion is not less than the reference position;

a memory configured to store a maximum value of a time interval between two sheets of the sheets discharged consecutively from the discharge opening as a first time interval, the first time interval being a time interval which enables the free-end portion which has once reached a position higher than the reference position upon being lifted up by the former sheet, to maintain a height not lower than the reference position without being lowered below the reference position, by being lifted up by the latter sheet upon being separated from the former sheet;

a first judging mechanism configured to judge whether or not a time interval of the two sheets discharged consecutively exceeds the first time interval; and a second judging mechanism configured to judge that the sheets loaded onto the tray up to a height not lower than the reference position, under a condition that the first judging mechanism judges that the time interval of the two sheets exceeds the first time interval, and under a condition that the signal transmission mechanism continues to transmit the second signal exceeding the first time interval.

* * * * *